US006192613B1

(12) United States Patent
Lantz

(10) Patent No.: US 6,192,613 B1
(45) Date of Patent: Feb. 27, 2001

(54) SHOOTING REST

(76) Inventor: Kenneth R. Lantz, Rte. 2 Box 919, Shinnston, WV (US) 26431

( * ) Notice: Subject to any disclaimer, the term of this patent is extended or adjusted under 35 U.S.C. 154(b) by 0 days.

(21) Appl. No.: 09/259,383

(22) Filed: Feb. 26, 1999

(51) Int. Cl.[7] ..... F41A 35/00; F41A 23/16
(52) U.S. Cl. ..... 42/94; 89/37.04
(58) Field of Search ..... 42/94; 89/37.04, 89/37.13

(56) References Cited

U.S. PATENT DOCUMENTS 4,007,554 * 2/1977 Helmstadter ..... 42/94
5,070,636 * 12/1991 Mueller ..... 42/94
5,419,233 * 5/1995 Mulvaney ..... 42/94
5,666,757 * 9/1997 Helmstadter ..... 42/94
6,044,747 * 4/2000 Felts ..... 42/94

* cited by examiner

*Primary Examiner*—J. Woodrow Eldred
(74) *Attorney, Agent, or Firm*—Aileen Champion Addessi

(57) ABSTRACT

A shooting rest for supporting a firearm includes at least three adjustable legs which can be positioned in various locations on the ground according to the terrain. A support bar is attached to one of the legs and to a base for providing support to the shooting rest. The shooting rest includes a first rest for supporting a rear portion of a gun and a second rest for supporting a front portion of a gun. The first rest is slidable on the base for accommodating various types of guns and is elongated for shooting straight ahead or at an angle without having to move the shooting rest. The shooting rest further includes an anchoring system having an anchor disposed into the ground and attached to the base for securing the base to the ground and stabilizing the shooting rest while shooting.

20 Claims, 5 Drawing Sheets

SHOOTING REST

BACKGROUND OF THE INVENTION

The invention relates to gun rests and, more particularly, to a shooting rest having adjustable legs for free standing on any type of terrain and which is foldable and compact for easy transportation and storage.

During target practice or hunting, it is often desirable to use a shooting rest to aid a person in supporting and stabilizing a gun. There are several kinds of shooting rests. One type of device is referred to as a monopod, which has one leg, and another type is referred to an a bipod, which has two legs, each type of shooting rest providing a rest for a firearm. However, these types of shooting rests are not free standing and must be held and supported by a person using the shooting rest, requiring the person to hold either the firearm or both the firearm and the shooting rest.

Yet another type of shooting rest is a table top gun rest, which is placed on top of a table, bench or other stable support surface. Another type of shooting rest is shooting bench which includes a chair mounted adjacent to the gun rest. However, these types of gun rests do not have an anchoring system for securing the gun rest to the ground or table for providing a steady rest for the firearm. Additionally, the table or the bench must also be carried to the shooting area.

Therefore, what is needed is an apparatus for providing a steady rest for a firearm which utilizes at least three adjustable legs for enabling the gun rest to be free standing on any type of terrain and which has an anchoring system for securing the gun rest to the ground for stabilization.

SUMMARY OF THE INVENTION

A shooting rest for resting a gun includes a base having a first surface and a second surface, each of the first and second surfaces having a first and a second side edge, a front edge, and a rear edge. At least three adjustable legs are attached to the second surface of the base. A first rest is slidably attached to the first surface of the base and has a first end and a second end which extend beyond the first and second side edges of the base for providing an elongated area for resting a rear portion of the gun and enabling adjustment of the positioning of the gun for shooting at various angles. The first rest is slidable between the front edge and the rear edge for accommodating various sized guns. A second rest is attached to the front edge of the first surface of the base and extends vertically upwardly and substantially perpendicular to the base for providing an area for resting a front portion of the gun. An anchoring mechanism is attached to the second surface of the base and extends downwardly toward the ground for securing the anchoring mechanism into the ground for stabilizing the shooting rest.

The three adjustable legs of the shooting rest may include each of the legs having at least two leg members which are telescopically attached together. One of the legs may be positioned forward of the other two legs and toward the front edge of the base, and the other two legs may be positioned extending toward the rear edge of the base.

The anchoring mechanism may further include a fastener attached to the second surface of the base and extending downwardly toward the ground, a strap attached to the fastener, a tightening mechanism having the strap disposed therethrough, and an anchor secured in the ground and attached to the strap for enabling a person to move the tightening mechanism to tighten the strap and pull the base and the anchor together for stabilizing the shooting rest with respect to the ground.

A support bar may be attached to the base and to one of the adjustable legs for providing support to the shooting rest. The bar support may be removably attached to the base and to a band slidably mounted on the leg with a wing nut and lock nut for folding the support bar against the leg during storage or transportation of the shooting rest.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

DESCRIPTION OF THE PREFERRED EMBODIMENT

Figure 1:
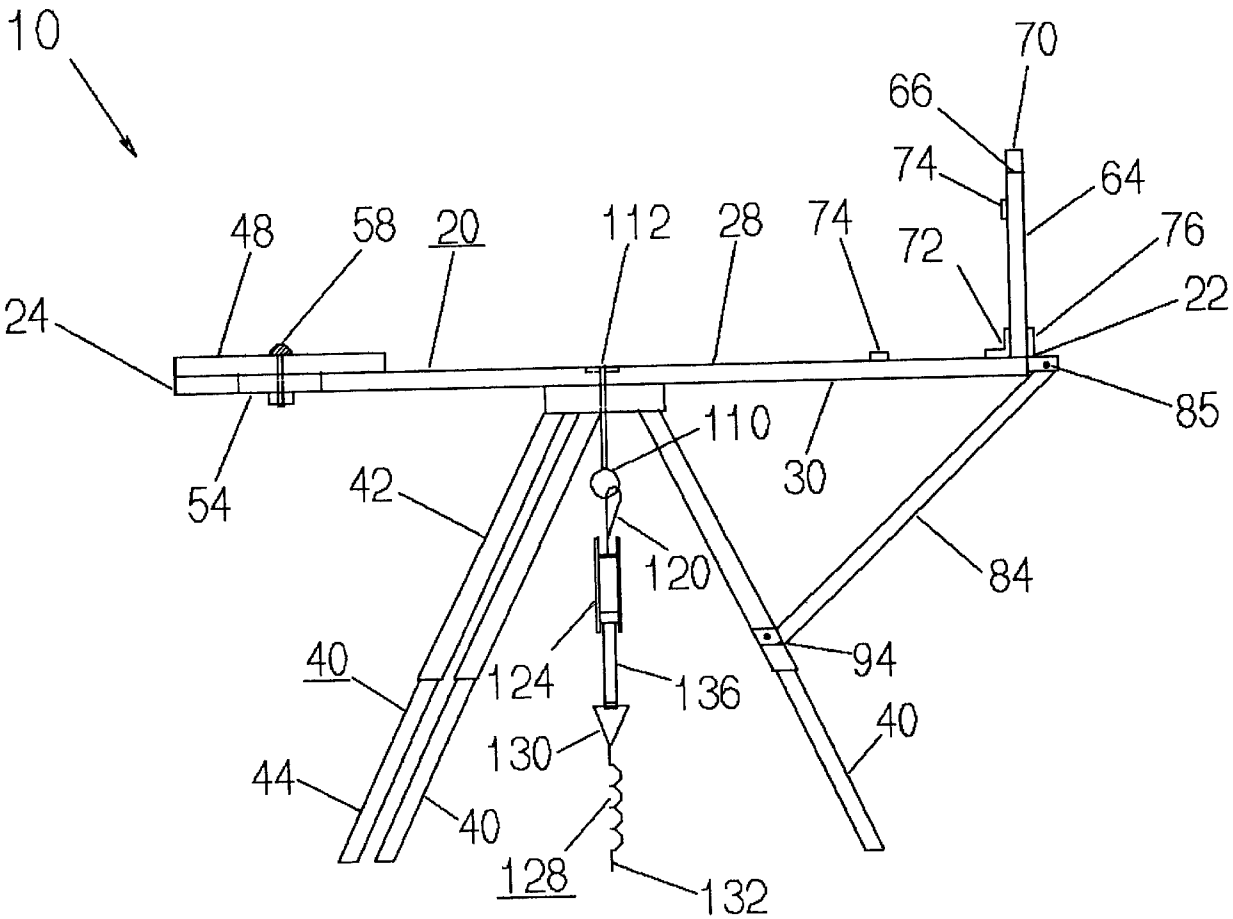
FIG. 1 is a side view of a shooting rest.
Figure 2:
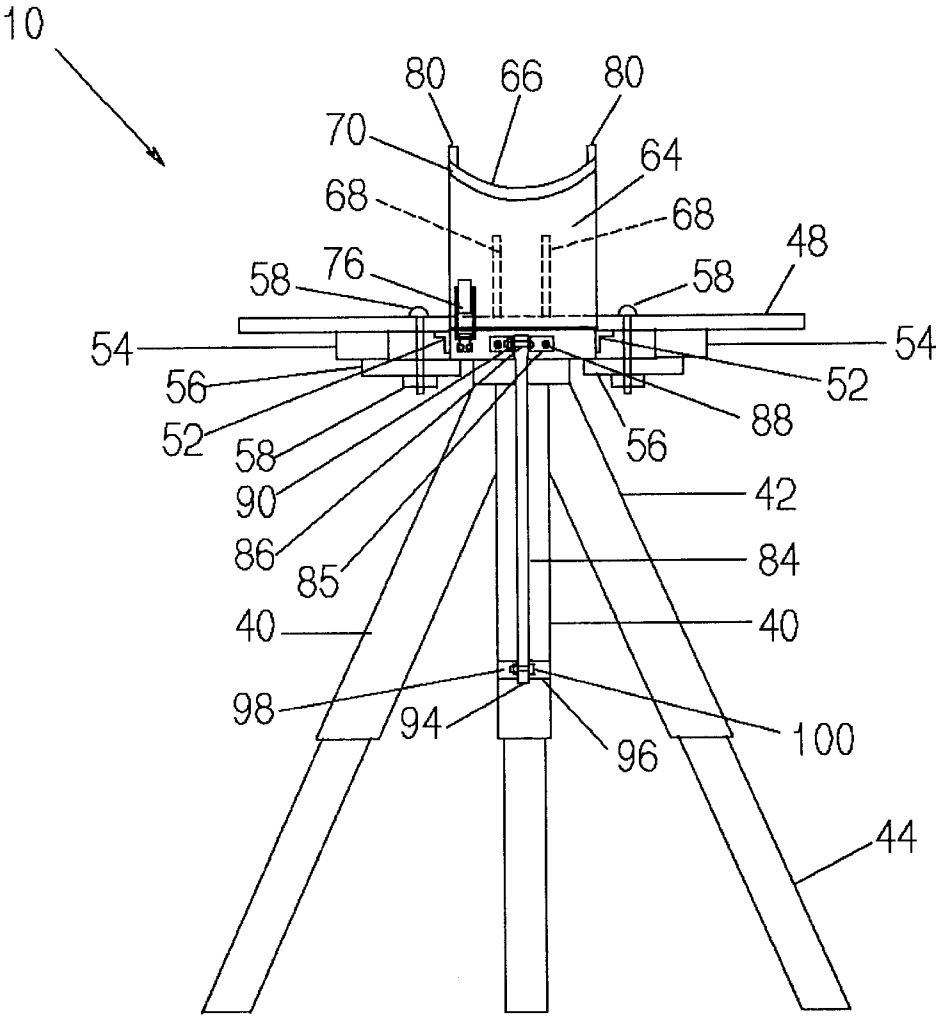
FIG. 2 is a front view of the shooting rest.
Figure 4:
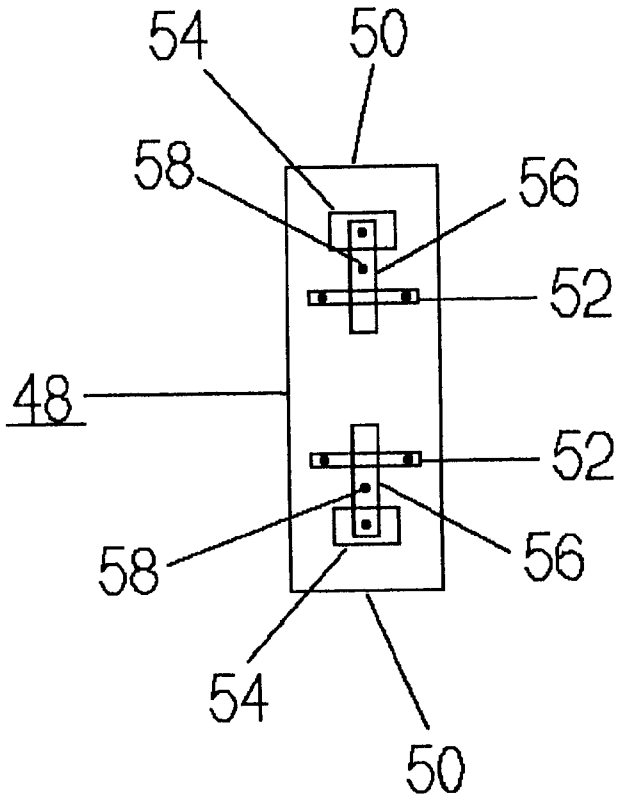
FIG. 4 is a bottom view of a first rest of the shooting rest.
Figure 3:
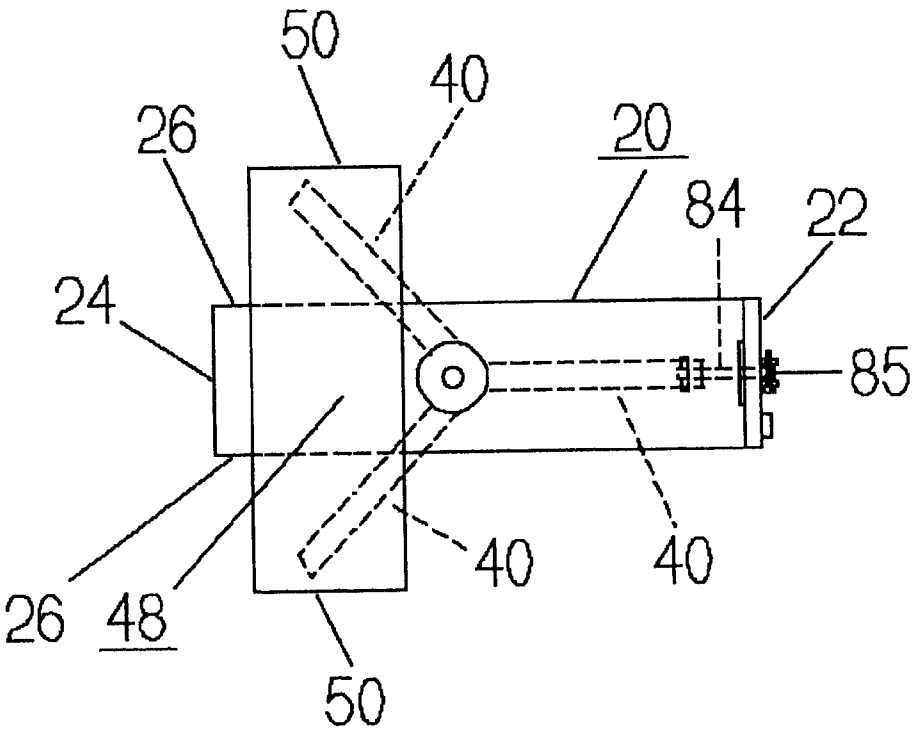
FIG. 3 is a top view of the shooting rest.

Referring to FIGS. 1–4, a shooting rest 10 includes a base 20 which is rectangularly shaped and has a front edge 22, a rear edge 24, and side edges 26. The base 20 has a first or top surface 28 and a second or underside surface 30.

The base 20 is attached to at least three adjustable legs 40. Each of the legs 40 may be formed of a single piece of material and be adjustable in that the legs 40 may be pivotally attached to the base 20 allowing the legs 40 to be swiveled or moved sideways according to the terrain. The legs 40 may be formed of a plurality of leg segments, such as a first leg member 42 and a second leg member 44 which are telescopically connected together, foldable, slidable, or the like for providing additional extension, height, and adjustability for the terrain for the shooting rest 10.

The legs 40 may be fixedly attached to the base 20 or may be detachable. Preferably, one of the legs 40 is positioned forward of the other two legs 40 and toward the front edge 22 of the base 20. The other two legs 40 are positioned toward the rear edge 24 of the base 20.

The shooting rest 10 includes a first rest 48 slidably attached to the base 20. The first rest 48 is an elongated member having portions, such as first and second ends 50, which when placed on top of the top surface 28 of the base 20 extend outwardly and beyond the side edges 26 of the base 20. The first rest 48 provides a surface area for resting the handle or rear portion of the firearm while shooting straight ahead. The first and second ends 50 of the first rest 48 provide a surface area for resting the handle or rear portion of the firearm for shooting at an angle without having to move the shooting rest 10.

The first rest 48 is attached to a guide mechanism for enabling the first rest 48 to be slidable on the base 20 between the front edge 22 and the rear edge 24 of the base 20 for accommodating various sized guns. For example, to shoot with a smaller pistol, the first rest 48 is slid forward toward the front edge 22 of the base 20, and to shoot with a larger pistol or rifle, the first rest 48 is slid backward away from the front edge 22 of the base 20. As one example of how the first rest 48 may slide with respect to the base 20, the guide mechanism includes a pair of guides 52 attached to the underside of the first rest 48 and positioned to align with the side edges 26 of the base 20. A brace 54 is attached outwardly of each guide 52. A clamp 56 is attached to each brace 54 and extends over the guide 52 and over the base 20. The clamp 56 is loosely attached to the brace 54 for allowing play between the clamp 56 and the brace 43 for enabling the clamp 56 to be adjusted. A fastener 58 is attached to the clamp 56 and is tightened to secure the base 20 between the clamp 56 and the first rest 48.

A second rest 64 is attached to the front edge 22 of the base 20 and provides a rest for the barrel, stock or front portion of the firearm. The second rest 64 extends vertically upwardly from the base 20 and is positioned substantially perpendicular to the base 20. The gun rests on a support surface 66 of the second rest 64, which has an arcuate shape for positioning of the gun.

As an example, the base 20, first rest 48 and second rest 64 are formed of wood, plastic, or the like for providing a lightweight shooting rest. Preferably, a support member, such as a plurality of screws 68 or the like, are disposed through or attached to the second rest 64 and against the grain of the wood for providing strength to the second rest 64 during shooting.

A pad 70, formed of closed cell foam, Styrofoam, plastic or any other type of cushioning material, is attached to the support surface 66 for absorbing the shock and movement of the gun during shooting and for protecting the finish of the gun.

A fastener mechanism is attached to the second rest 64 and to the base 20 for enabling the components of the shooting rest 10 to be secured together and to be foldable with respect to one another. As one example, the fastener mechanism includes a hinge 72, a fastener 74, and a latch 76. The hinge 72 is attached to the second rest 64 and to the base 20 for folding the second rest 64 onto the base 20 for easy transportation and storage of the shooting rest 10. The fastener 74, such as fibrous adhesive patched marketed under the name Velcro, mechanical means, or the like, is attached to the second rest 64 and to the base 20 for securing the second rest 64 to the base 20 while in the folded position. The latch 76 is attached to the second rest 64 and to the base 20 for securing the second rest 64 is the upright or unfolded position during shooting.

As an alternative embodiment, a side support 80 may be attached at each end of the support surface 66 for restricting movement of the gun between the side supports 80.

The shooting rest 10 further includes a support bar 84 attached to the front edge 22 or to the underside 30 of the base 20 and to the forwardly positioned leg 40 for providing strength and stabilization to the shooting rest 10. As one example of how the support bar 84 may be attached to the base 20, an attachment mechanism includes a bracket 85 attached to the front edge 32 of the base 20 and protruding therefrom. A threaded member 86, such as a piece of threaded rod, is disposed through a hole in the bracket 85, through a hole in the support bar 84, and through a second hole in the bracket 85. The threaded member 86 may be secured in position with a wing nut 88 and a lock nut 90. As one example of the attachment of the support bar 84 to the leg 40, the attachment mechanism may include a band 94 slidably mounted onto the leg 40 and a threaded member 96 disposed through holes in the band 94 and through holes in the support bar 84 and secured with a wing nut 98 and a lock nut 100. By loosening the wing nut 98 at the leg 40 and by removing the wing nut 88 and lock nut 90 from the base 20, the support bar 84 and band 94 can be slid along the leg 40 for folding the support bar 84 against the leg 40 for easy transportation and storage of the shooting rest 10. Alternatively, a locking wing nut or the like may be used for securing the support bar 84.

The shooting rest 10 also includes an anchoring system for securing the base 20 to the ground. The anchoring system includes a fastener 110, such as an eye bolt, clip, bolt, screw, or the like, which extends into the base 20. Preferably, the fastener 110 is positioned centrally between the three legs 40 which extend beneath the base 20. The fastener 110 and/or legs 40 may be secured to the base 20 with a T-nut 112 or any other type of securement means.

The fastener 110 may be attached to a clip 120. A tightening mechanism 124, such as a ratchet mechanism, turn-buckle or the like, is attached to the clip 120. The clip 120 provides convenient removal of the ratchet mechanism 124 from the fastener 110.

An anchor 128 having a catch 130 and a securement member 132 is pushed into the ground. The catch 130 may be a eye bolt, hook or the like. The securement member 132 may be a cork screw, pin or any other type of anchoring member which may be positioned and firmly held within the ground.

A strap 136 is disposed through the tightening mechanism 124 and attached to the anchor 128, such as by disposing the strap 136 through the catch 130. The tightening mechanism 124 is rotated to tighten the strap 136 and pull the base 20 toward the ground for securing the shooting rest 10 to the ground and providing a stable, solid rest for the firearm.

For the various embodiments of this invention, the same reference characters will be used to designate like parts. In addition, like functions and like interactions of the parts among the various embodiments of this invention will not be repeated for each embodiment.

Figure 5:
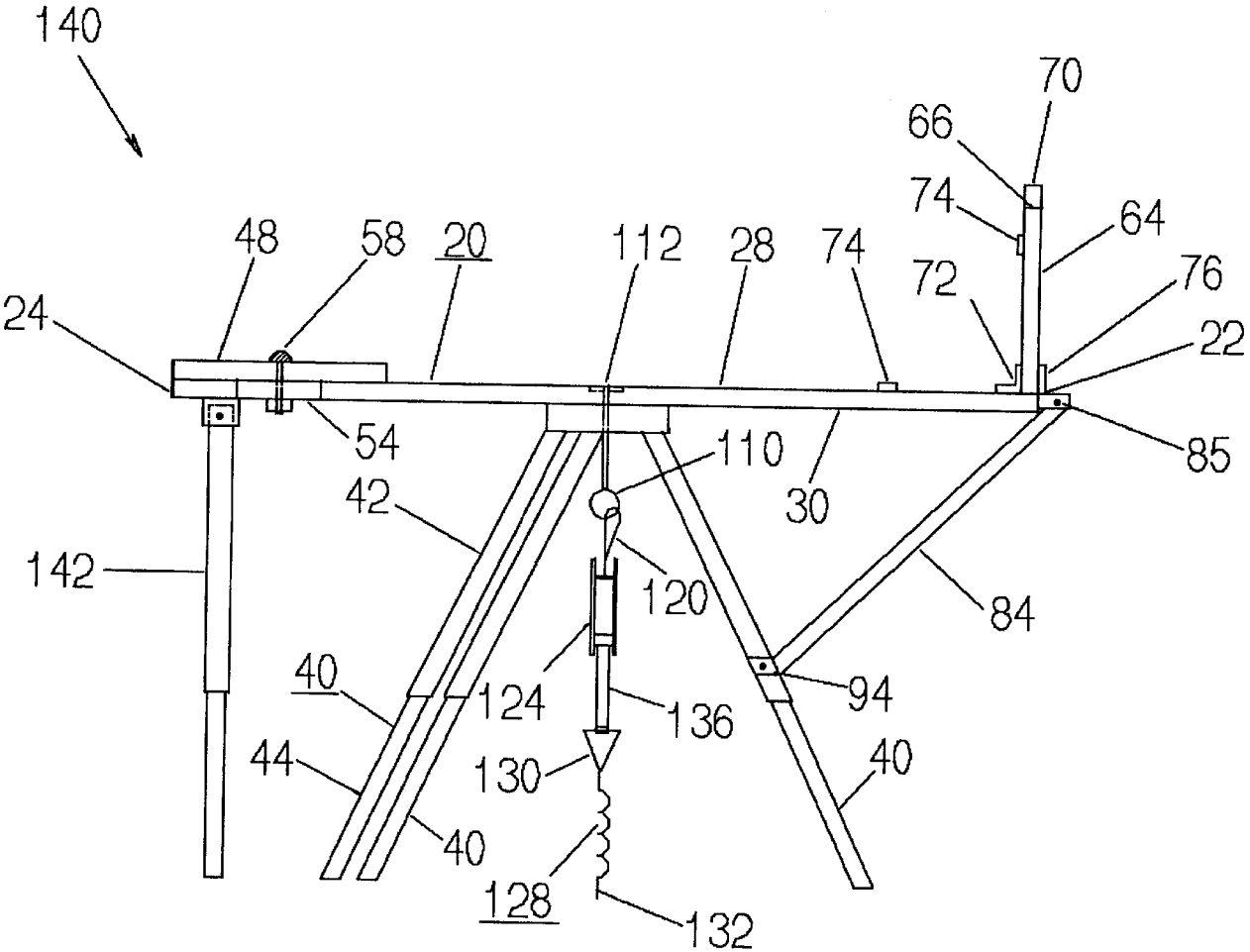
FIG. 5 is an alternative embodiment of the shooting rest of FIG. 1.

Referring to FIG. 5 and using the same reference characters to define like parts, an alternative embodiment of the shooting rest 10 as illustrated in FIGS. 1–4 may be a shooting rest 140 having like parts as the shooting rest 10 and additionally having a fourth leg 142 attached to the rear edge 24 of the base 20 for supporting the rear of the base 20.

Figure 6:
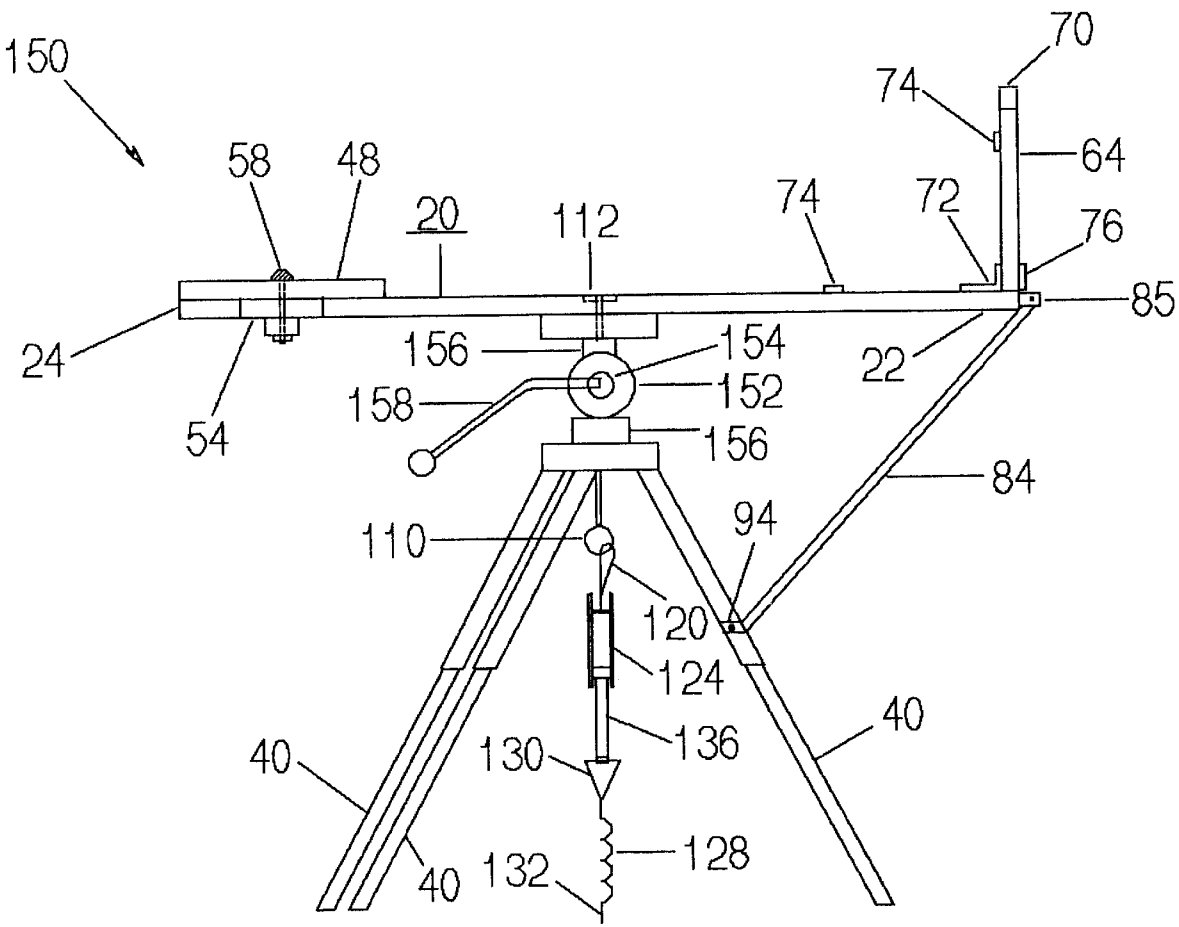
FIG. 6 is an alternative embodiment of the shooting rest of FIG. 1.

Referring to FIG. 6 and using the same reference characters to define like parts, an alternative embodiment of the shooting rest 10 as illustrated in FIGS. 1–4 may be a shooting rest 150 having like parts as the shooting rest 10 and additionally having a pivoting member 152. The legs 40 may be mounted on the pivoting member 152 allowing the base 20 to swivel or be rotated with respect to the legs 40 and to the anchoring system for enabling a person to shoot in different directions without having to move the anchoring system and the shooting rest. The pivoting member 152 may include ball joints 154 mounted on bracket supports 156 or any other type of pivotal system. A handle 158 is attached to the pivoting member 152 for enabling a person to grasp the handle 158 for easily rotating the base 20.

In operation, a person may carry the folded, compact and lightweight shooting rest 10, 140 or 150 to the desired shooting location. The legs 40 are adjusted to the proper height and/or position on the terrain for positioning the base 20 substantially level. The second rest 64 is unfolded and latched in an upright position.

The first rest 48 is positioned on the top surface 28 of the base 20 in the desired position and the clamp 56 is tightened to secure the first rest 48 to the base 20. The clamp 56 may be loosened to enable the first rest 48 to slide along the top of the base 20 to adjust the positioning of the first rest 48 depending on the size of the gun. The support bar 84 is positioned and secured.

The anchor 128 is positioned in the ground. The tightening mechanism 124 is attached to the base 20. The strap 136 is wrapped around the anchor 128 and is fed through the tightening mechanism 124. The tightening mechanism 124 is then tightened to secure the base 20 to the ground.

To shoot straight ahead, the front portion of the gun is placed on the second rest 64 and the rear portion of the gun is placed centrally on the first rest 48. To shoot at an angle, the front portion of the gun is placed on the second rest 64 and the rear portion of the gun is placed on either of the first and second ends 50 of the first rest 48 depending on whether a person desires to shoot in a direction angled to the right or to the left.

An advantage of the shooting rests 10, 140 and 150 is the use of three legs to enable the shooting rest to be free standing. A person is not required to support or hold the shooting rest during shooting. Also, the adjustability of the legs enables the shooting rest to be used on all terrains and still maintain the base 20 and first and second rests 50 and 64 substantially level. The adjustability also allows the use of a seat of any height or allows a person to stand.

Other types of shooting rests require the use of a table, bench or chair. The shooting rests 10, 140 and 150 do not require the use of a table, bench or chair.

Other advantages of the shooting rest include a front support, or first rest 48, which is slidable for accommodating various sized guns and also has portions which extend outwardly for enabling the gun to be positioned at various angles for enabling a person to shoot in numerous directions without having to move the shooting rest. The shooting rest includes a back support, or second rest 64 for the gun providing an additional gun support. The shooting rest has a support bar 84 for providing additional support and stabilization to the base 20.

Another advantage is the use of an anchoring system which provides a solid and secure shooting rest during shooting. The anchoring system may be easily installed, tightened and loosened for quick set-up and movement to an alternative location.

Yet another advantage of the shooting rests 10 and 140 is that the shooting rest is foldable, compact and lightweight making the shooting rest easy to transport and store.

Thus there has been shown and described a novel shooting rest which fulfills all the objects and advantages sought therefor. Many changes, modifications. variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

I claim:

1. A shooting rest for resting a gun, comprising:

a base having a first surface and a second surface, each of said first and second surfaces having a first side edge, a second side edge, a front edge, and a rear edge;

at least three adjustable legs attached to said base;

a first rest slidably attached to said base, said first rest having a first end and a second end extending beyond said first and second side edges of said base for providing an elongated area for resting a rear portion of said gun and enabling adjustment of the positioning of said gun for shooting at various angles, said first rest slidable between said front edge and said rear edge of said base for accommodating various sized guns;

a second rest attached to said front edge of said base and extending vertically upwardly and substantially perpendicular to said base for providing an area for resting a front portion of said gun; and an anchoring mechanism attached to said base and extending downwardly toward the ground for securing said anchoring mechanism into the ground for stabilizing said shooting rest.

2. The shooting rest according to claim 1, wherein said at least three adjustable legs include each of said legs having at least two leg members which are telescopically attached together.

3. The shooting rest according to claim 1, wherein said at least three adjustable legs include one of said legs positioned forward of the other two legs and toward said front edge of said base, and the other two legs positioned extending toward said rear edge of said base.

4. The shooting rest according to claim 1, wherein said anchoring mechanism further comprises:

a fastener attached to said second surface of said base and extending downwardly toward the ground;

a strap attached to said fastener;

a tightening mechanism having said strap disposed therethrough; and an anchor secured in the ground and attached to said strap for enabling a person to move said tightening mechanism to tighten said strap and pull said base and said anchor together for stabilizing said shooting rest with respect to the ground.

5. The shooting rest according to claim 1, further comprising a support bar attached to said base and to one of said adjustable legs for providing support to said shooting rest.

6. The shooting rest according to claim 5, further comprising:

a band slidably attached to said leg; and said support bar removably attached to said base for folding said support bar against said leg during storage of said shooting rest.

7. The shooting rest according to claim 1, further comprising a pad attached to said second rest for providing cushioning during shooting and protecting the finish of said gun.

8. The shooting rest according to claim 1, further comprising an attachment mechanism attached to said second rest and to said base for folding said second rest against said base during storage of said shooting rest.

9. The shooting rest according to claim 1, further comprising a pivoting member attached to said base and to said at least three adjustable legs for enabling said base to rotate with respect to said legs for altering the positioning of said gun without removing said anchoring mechanism from the ground.

10. The shooting rest according to claim 1, further comprising a fourth adjustable leg attached to said base and extending toward said rear edge of said base for providing additional support to said shooting rest.

11. A shooting rest for resting a gun, comprising:

a base having a first surface and a second surface, each of said first and second surfaces having a first and a second side edge, a front edge, and a rear edge;

at least three adjustable legs attached to said second surface of said base, each of said legs having at least two leg members which are telescopically attached together, one of said legs positioned forward of the other two legs and toward said front edge of said base, and the other two legs positioned extending toward said rear edge of said base;

a support bar attached to said base and to said forwardly positioned adjustable leg for providing support to said shooting rest;

a first rest slidably attached to said first surface of said base, said rest having a first end and a second end extending beyond said first and second side edges of said base for providing an elongated area for resting a rear portion of said gun and enabling adjustment of the positioning of said gun for shooting at various angles, said rest slidable between said front edge and said rear edge for accommodating various sized guns;

a second rest attached to said front edge of said base and extending vertically upwardly and substantially perpendicular to said base for providing an area for resting a front portion of said gun; and an anchoring mechanism attached to said second surface of said base and extending downwardly toward the ground for securing said anchoring mechanism into the ground for stabilizing said shooting rest.

12. The shooting rest according to claim 11, wherein said anchoring mechanism further comprises:

a fastener attached to said second surface of said base and extending downwardly toward the ground;

a strap attached to said fastener;

a ratchet mechanism having said strap disposed therethrough; and an anchor secured in the ground and attached to said strap for enabling a person to move said ratchet mechanism to tighten said strap and pull said base and said anchor together for stabilizing said shooting rest with respect to the ground.

13. The shooting rest according to claim 11, further comprising:

a band slidably attached to said leg; and said support bar removably attached to said base and to said band on said leg for folding said support bar against said leg during storage of said shooting rest.

14. The shooting rest according to claim 11, further comprising a pivoting member attached to said base and to said at least three adjustable legs for enabling said base to rotate with respect to said legs for altering the positioning of said gun without removing said anchoring mechanism from the ground.

15. The shooting rest according to claim 11, further comprising:

a pad attached to said second rest for providing cushioning during shooting and protecting the finish of said gun; and said second rest having an arcuate shape for resting a front portion of said gun and having side supports extending vertically upwardly for restricting sideways movement of said gun between said side supports.

16. A shooting rest for resting a gun, comprising:

a base having a first surface and a second surface, each of said first and second surfaces having a first and a second side edge, a front edge, and a rear edge;

at least three adjustable legs attached to said second surface of said base;

a first rest slidably attached to said first surface of said base, said rest having a first end and a second end extending beyond said first and second side edges of said base for providing an elongated area for resting a rear portion of said gun and enabling adjustment of the positioning of said gun for shooting at various angles, said rest slidable between said front edge and said rear edge for accommodating various sized guns;

a second rest attached to said front edge of said base and extending vertically upwardly and substantially perpendicular to said base for providing an area for resting a front portion of said gun;

a fastener attached to said second surface of said base and extending downwardly toward the ground;

a strap attached to said fastener;

a tightening mechanism having said strap disposed therethrough; and an anchor secured in the ground and attached to said strap for enabling a person to move said tightening mechanism to tighten said strap and pull said base and said anchor together for stabilizing said shooting rest with respect to the ground.

17. The shooting rest according to claim 16, wherein said at least three adjustable legs include each of said legs having at least two leg members which are telescopically attached together.

18. The shooting rest according to claim 16, wherein said at least three adjustable legs include one of said legs positioned forward of the other two legs and toward said front edge of said base, and the other two legs positioned extending toward said rear edge of said base.

19. The shooting rest according to claim 16, further comprising a support bar attached to said base and to one of said adjustable legs for providing support to said shooting rest.

20. The shooting rest according to claim 16, further comprising a pivoting member attached to said base and to said at least three adjustable legs for enabling said base to rotate with respect to said legs for altering the positioning of said gun without removing said anchor from the ground.

* * * * *